US007530930B2

(12) United States Patent
Liao et al.

(10) Patent No.: US 7,530,930 B2
(45) Date of Patent: May 12, 2009

(54) EXERCISE APPARATUS

(75) Inventors: Hung-Mao Liao, Taichung (TW); Te-Chang Huang, Chang-Hua Hsien (TW)

(73) Assignee: Johnson Health Tech Co., Ltd., Taichung Hsien (TW)

( * ) Notice: Subject to any disclaimer, the term of this patent is extended or adjusted under 35 U.S.C. 154(b) by 284 days.

(21) Appl. No.: 11/497,139

(22) Filed: Aug. 2, 2006

(65) Prior Publication Data

US 2008/0032867 A1 Feb. 7, 2008

(51) Int. Cl.
*A63B 69/16* (2006.01)

(52) U.S. Cl. ..... 482/57; 482/52

(58) Field of Classification Search ..... 482/51, 482/52, 57, 70, 79, 80
See application file for complete search history.

(56) References Cited

U.S. PATENT DOCUMENTS

| | | | | |
|---|---|---|---|---|
| 6,007,462 | A | 12/1999 | Chen | |
| 6,390,954 | B1 | 5/2002 | Lee | |
| 6,672,992 | B1 | 1/2004 | Lo | |
| 6,719,666 | B1 | 4/2004 | Lo | |
| 6,994,656 | B2 | 2/2006 | Liao et al. | |
| 7,361,122 | B2 * | 4/2008 | Porth | 482/52 |
| 7,377,881 | B2 * | 5/2008 | Moon | 482/52 |
| 7,404,785 | B2 * | 7/2008 | Stearns et al. | 482/52 |

FOREIGN PATENT DOCUMENTS

CN 1202836 A 12/1998

* cited by examiner

*Primary Examiner*—Glenn Richman

(57) ABSTRACT

An exercise apparatus is disclosed herein, including a frame, a rotating assembly, two supporting rods, two swing arms, two links, and two pedals. The front ends of the supporting rods are connected respectively to two connecting points of the rotating assembly, and the rear end of each supporting rod moves back and forth along a corresponding track. The front ends of the links are connected respectively at two swing ends of the swing arms. Each pedal is mounted at the rear end of a corresponding link and pivotally coupled to a corresponding supporting member. The distance between the bottom of a circular path of the connecting points and the tracks is smaller than 10 cm. The length of the supporting rod is smaller than two times diameter of the circular path. The longitudinal horizontal distance between the front edge of the closed path and the rear edge of the circular path is smaller than 20 cm. The rear ends of the supporting rods are located between the front ends and rear ends of the pedals.

9 Claims, 9 Drawing Sheets

EXERCISE APPARATUS

BACKGROUND

1. Field of Invention

This invention relates to an exercise apparatus and, more particularly to an elliptical exercise apparatus with small size for reducing space occupation.

2. Prior Art

Elliptical exercise apparatus has been popular in recent years. Generally, elliptical exercise apparatus can guide a left pedal and a right pedal to move along an elliptical moving path for simulating walking, running, and stair climbing.

For example, an elliptical exercise apparatus is disclosed in U.S. Pat. No. 6,390,954. The elliptical exercise apparatus comprises a crank mounted at the front end of the frame; left and right tracks mounted at the rear end of the frame; left and right supporting rods mounted on left and right sides respectively; and left and right swing arms mounted at the front end of the frame. The front end of each supporting rod pivotally connects to a crank arm of the crank, so that the front ends can move along a circular path. The left and right supporting rods each has a roller mounted pivotally on the rear end, and the rollers move back and forth on the tracks. Two pedals are mounted respectively to the upper surfaces of the middle sections of supporting rods. Each swing arm has a top end for forming a handle, and a lower end connects to the corresponding supporting rod via a link. The left and right pedals move along a substantial elliptical closed path, and the left and right handles move back and forth correspondingly with the pedals.

The aforesaid elliptical exercise apparatus suffers from some shortcomings. First, the motion path of the pedals needs an adequate longitudinal length for exercising a user's legs, and the tracks at the rear end of the frame are longer than the longitudinal length of the motion path of the pedals, so the longitudinal length of the elliptical exercise apparatus is so long that it needs more space to be placed. Second, because the pedals are fixed securely on the supporting rods, the angle of the pedals varies with the motion path of the supporting rods. During operation period, the movement status of the user's feet is not conformed to the actual movement status. Preferably, the upper surface of each pedal is substantially horizontal when the pedal is at the bottom of the path. When the pedal is in the other segments, the front end of the pedal should be lower than the rear of the pedal, and it is apparent when the pedal is at the top of the path.

U.S. Pat. No. 6,007,462 shows a small elliptical exercise apparatus which includes a frame; a crank mounted at the rear end of the frame; left and right swing arms mounted pivotally at the front end of the frame; and left and right supporting rods connected respectively to the lower ends of the swing arms and corresponding crank arm. Two pedals are mounted on the supporting rods respectively. Thereby the left and right pedals move along a substantial elliptical closed path. The longitudinal length of the elliptical exercise apparatus is small enough to be placed in a limited space. However, the pedal motion doesn't conform with ergonomics. When each pedal moves to the bottom of the elliptical path, the front end of the pedal is higher than the rear end of the pedal. But the real situation is that while a person is walking or running, while his foot is on the ground, the sole of the foot should be horizontal on the ground surface.

SUMMARY

In a preferred embodiment of the present invention, the elliptical exercise apparatus comprises: a frame adapted to rest on a surface, the frame including a front end, a rear end, a front region, and a rear region, the rear region having two tracks extending longitudinally; a rotating assembly mounted on the front region of the frame and having two opposite connecting points moving along a circular path, and the distance between the bottom of the circular path and the tracks is smaller than 10 cm; a flywheel mounted pivotally on the front region of the frame and connected to the rotating assembly, the flywheel being rotatable simultaneously with the connecting points; left and right supporting rods each having a front end, a rear end, and a supporting member there between, the respective distances between the front ends and the corresponding rear ends of the supporting rods being greater than the diameter of the circular path and smaller than two times diameter of the circular path, the supporting member located between the rear and the middle of the supporting rod, the front ends of the supporting rods connected pivotally to the connecting points respectively, the rear ends of the supporting rods moving along the track between a front point and a rear point so as to cause the supporting member to move along an actuate closed path, therefore in the longitudinal direction, the front edge of the closed path aligns transversely or is in back of the rear edge of the circular path, and the longitudinal horizontal distance between the front edge of the closed path and the rear edge of the circular path is smaller than 20 cm; left and right swing arms each having a pivot point connected to the front region of the frame, and a swing end located below the pivot point for moving back and forth; left and right links each having a front end and a rear end, the front ends respectively pivotally connected to the corresponding swing ends of the swing arms; and left and right pedals connected respectively to the rear ends of the links and located behind the corresponding supporting members of the supporting rods, the left and right pedals further connected pivotally to the supporting members; wherein in the longitudinal direction, the front point of the track aligns transversely or is in back of the front edge of the motion path of the front ends of the pedals, and the rear point of the track aligns transversely or is in front of the rear edge of the motion path of the rear ends of the pedals.

Several objects and advantages of the present invention are: (a) to provide an elliptical exercise apparatus with an adequate path for the travel by a user's feet; (b) to provide an elliptical exercise apparatus with an ergonomic pedal motion; (c) to provide an elliptical exercise apparatus with a shorter longitudinal length.

DETAIL DESCRIPTION

Figure 1:
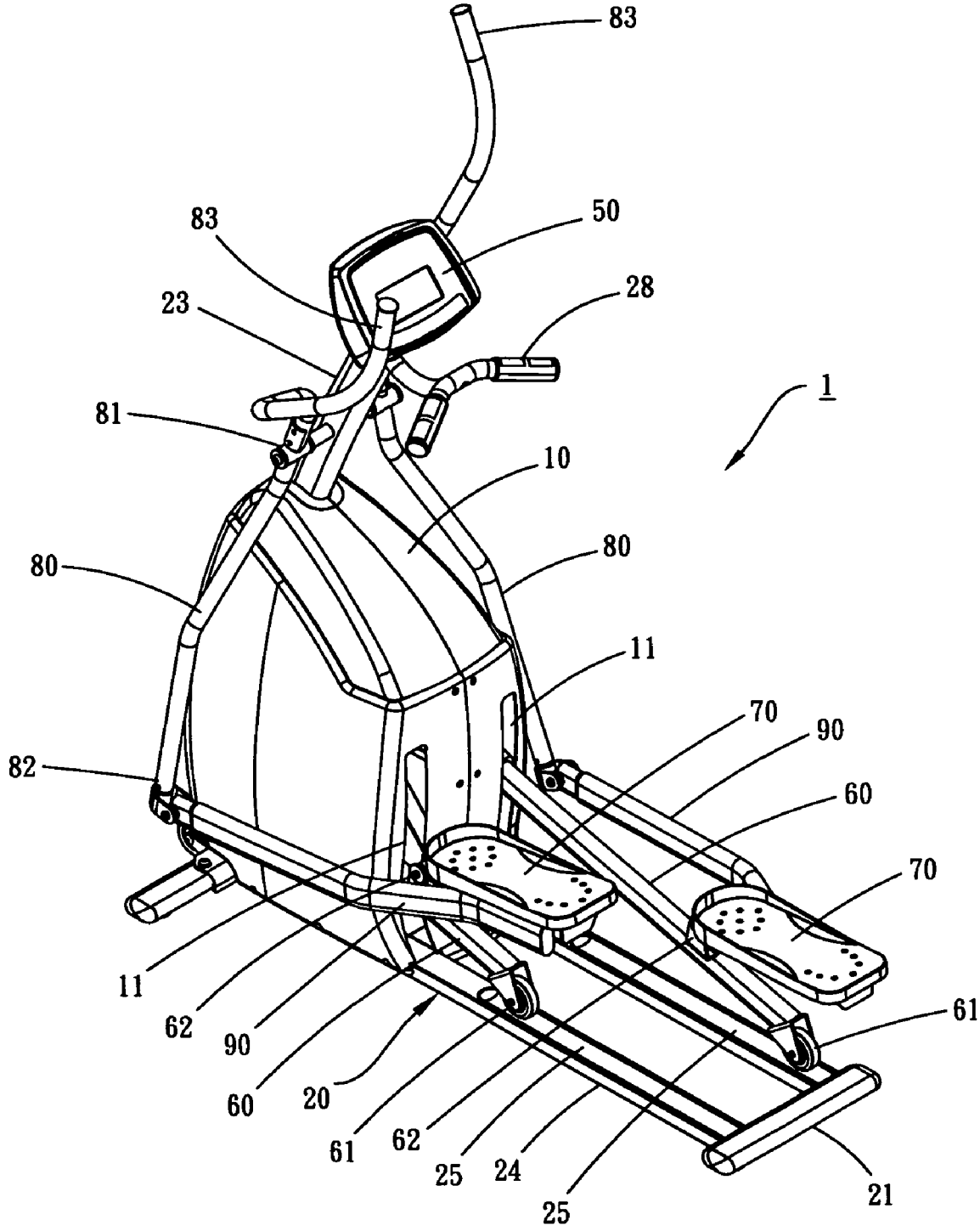
FIG. 1 is a perspective view of a preferred embodiment of the present invention.

Referring now specifically to the figures, in which identical or similar parts are designated by the same reference numerals throughout, a detailed description of the present invention is given. It should be understood that the following detailed description relates to the best presently known embodiment of the invention. However, the present invention can assume numerous other embodiments, as will become apparent to those skilled in the art, without departing from the appended claims.

A preferred embodiment elliptical exercise apparatus constructed according to the present invention is designated 1 in FIGS. 1-6, wherein FIGS. 3-6 illustrate the elliptical exercise apparatus 1 without a shroud 10.

Figure 2:
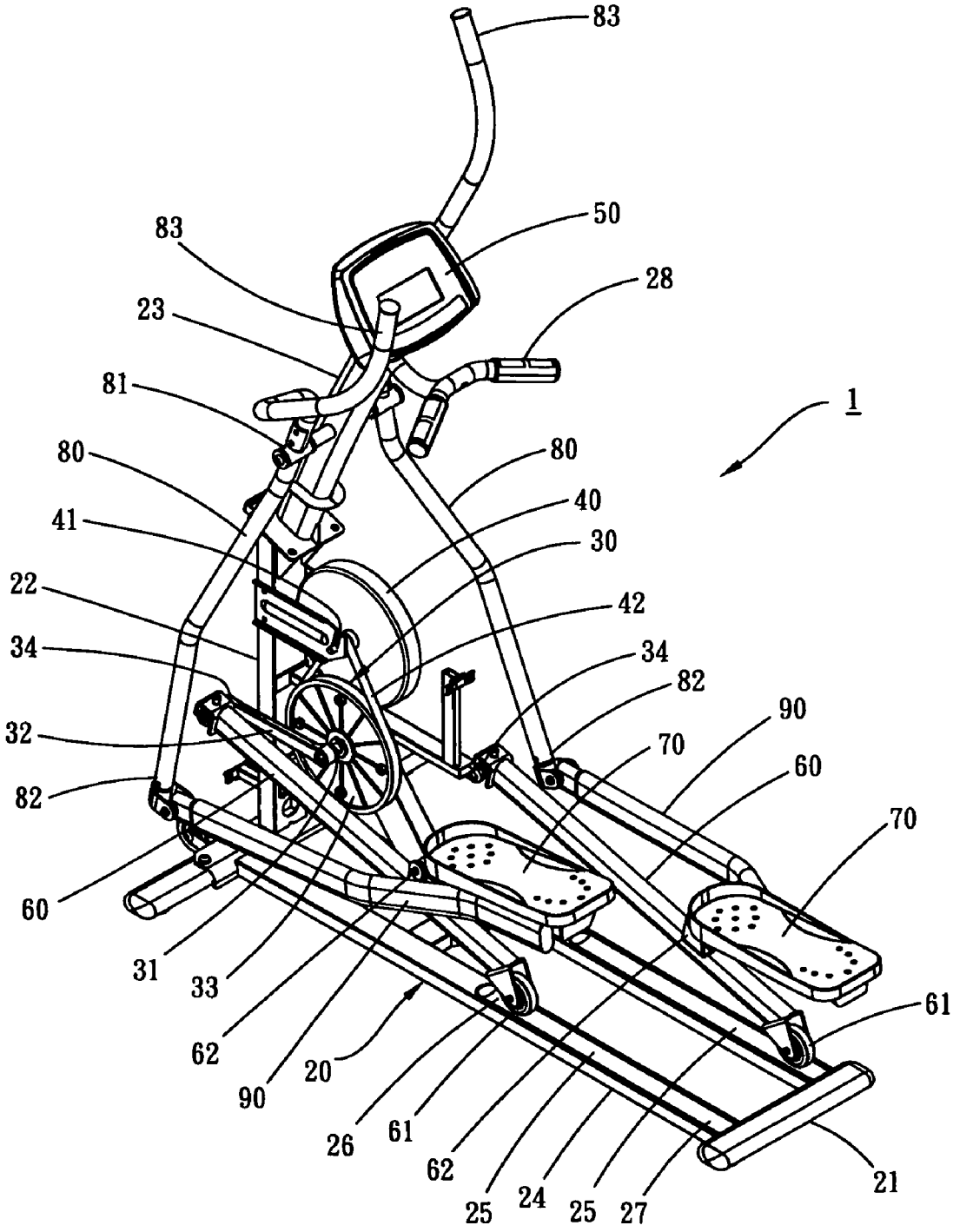
FIG. 2 is a perspective view of the preferred embodiment of FIG. 1 without the shroud.
Figure 3:
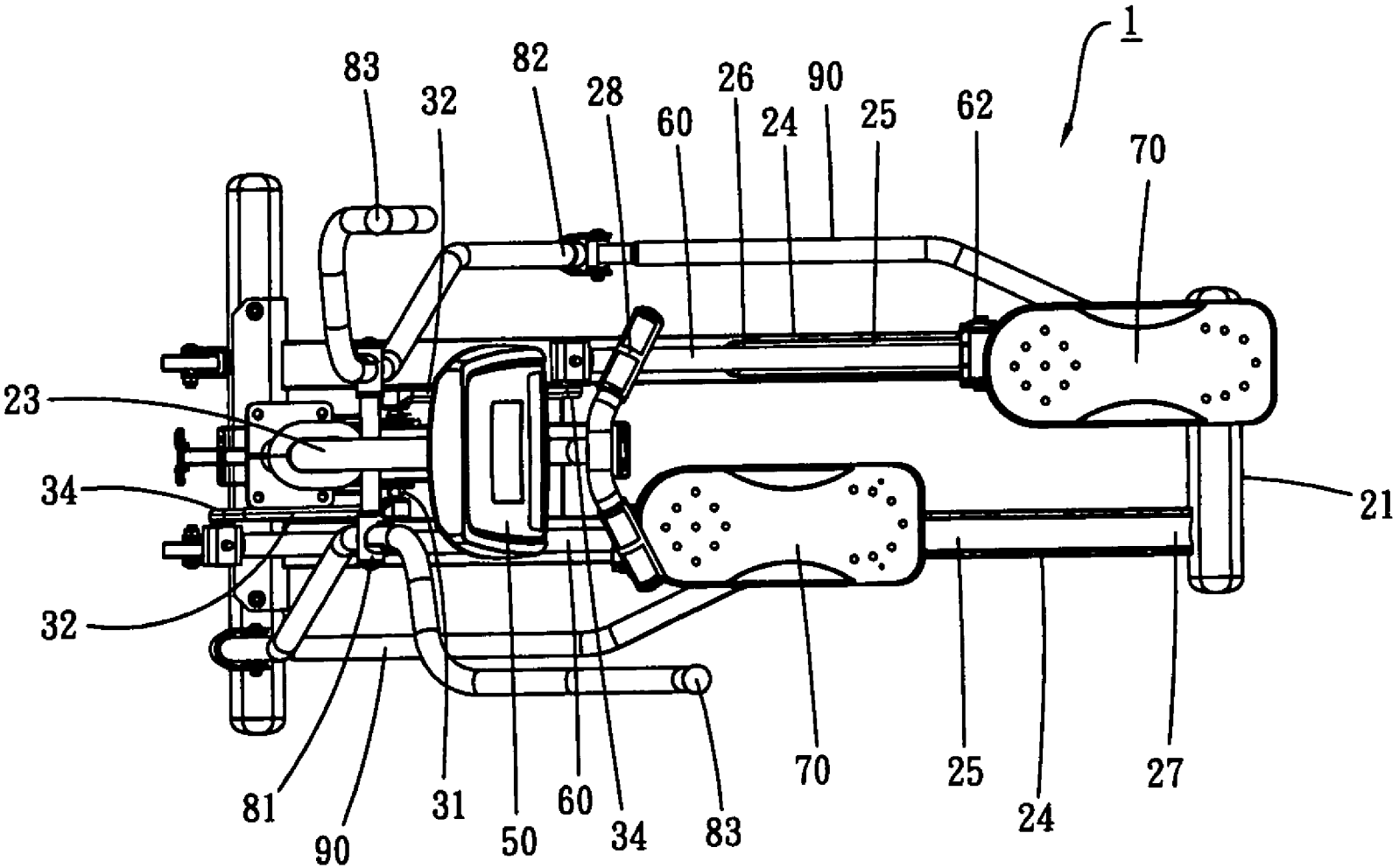
FIG. 3 is a top plan view of the preferred embodiment of FIG. 1 without the shroud.

Now referring to FIG. 2, the elliptical exercise apparatus 1 comprises a frame 20 which is composed of a base 21 resting on a ground surface, a frame support 22 mounted at a front end of the base 21, and a console mast 23 extending upwardly from the frame support 22.

Figure 4:
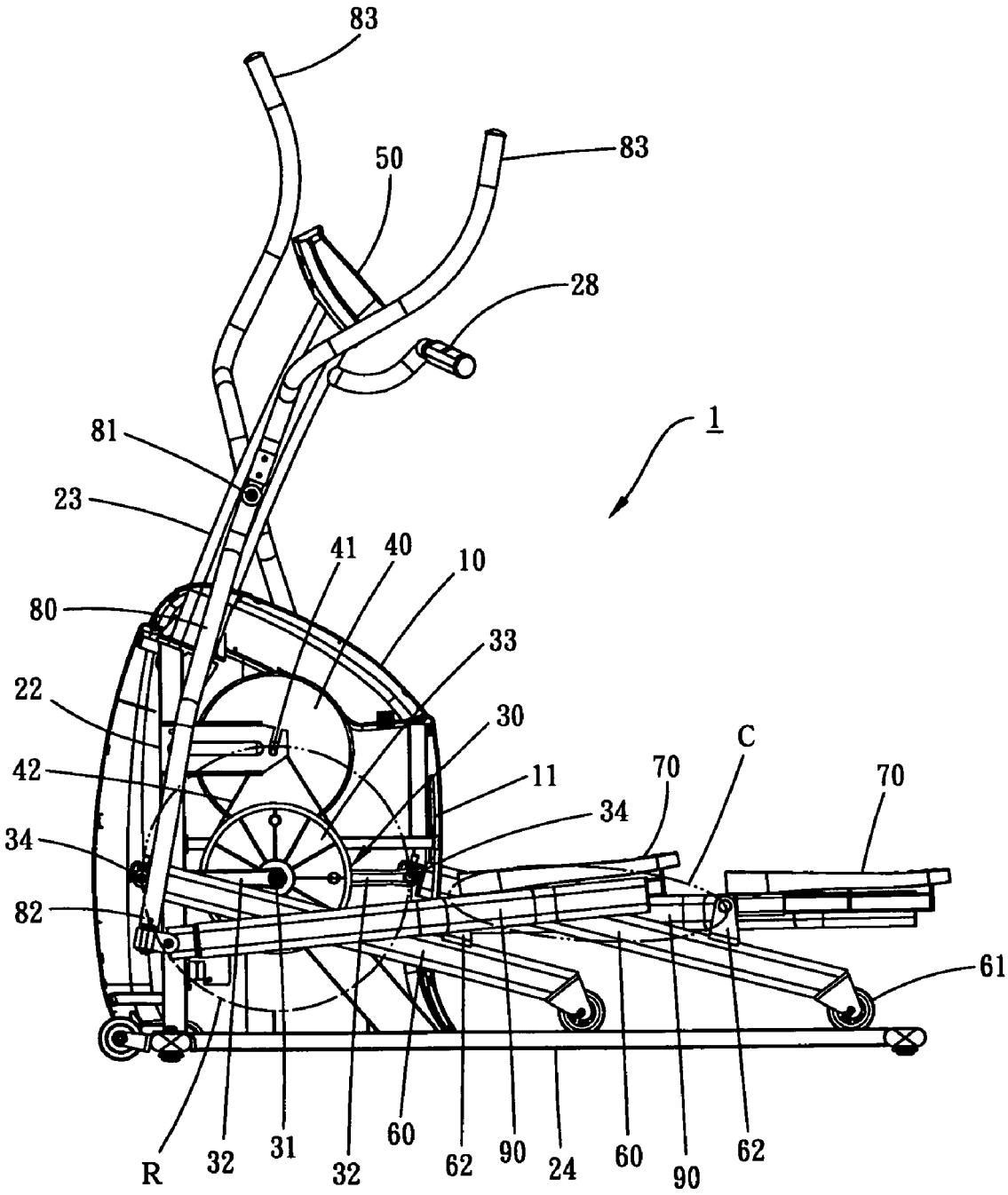
FIG. 4 is a left side view of the preferred embodiment of FIG. 1 without the left half shroud, and two pedals respectively are at a front end and a rear end within a movement area.

The frame support 22 includes a rotating assembly 30 which has a crank pivot 31, two crank arms 32 and a large pulley 33. The crank pivot 31 pivots to the frame support 22. The crank arms 32 are secured respectively and symmetrically to the opposite ends of the crank pivot 31, and there is an angular difference of 180 degrees between the two crank arms 32. The outer ends of the crank arms 32 form two connecting points 34. As shown in FIG. 4, each connecting point 34 moves along a circular path R. Now referring to FIG. 5, the bottom of the circular path R is very close to the ground. In other words, the outer end of the crank arm 32 is very close to the ground when the crank arm 32 rotates to a direction front to the ground. More specifically, the distance between the outer end of the crank arm 32 and the ground surface is less than 10 cm. The large pulley 33 locates between the two crank arms and coaxially pivots to the crank pivot 31.

The rotating assembly 30 further has a flywheel 40 mounted pivotally on the frame support 22. The diameter of the flywheel 40 is smaller than the diameter of the circular path R, and the rear edge of the flywheel 40 is in front of the rear edge of the circular path R. In other words, as shown in FIG. 4, the flywheel 40 is located on the motion boundary of the crank arm 32. A small pulley 41 is mounted on a left side of the flywheel 40 and positioned over the large pulley 33 of the rotating assembly 30. The flywheel 40 and the small pulley 41 are coaxial. A belt 42 connects the small pulley 41 and the large pulley 33, so that the flywheel 40 and the rotating assembly 30 can rotate simultaneously in a predetermined rotational speed ratio.

In addition, elliptical exercise apparatus 1 generally comprises an eddy-current brake (not shown) located near the flywheel 40. The eddy-current brake comprises a movable magnetic assembly, and a user can use the console 50 to adjust a distance between the flywheel 40 and the movable magnetic assembly for adjusting a rotating resistance of the flywheel 40.

Now referring to FIGS. 1 and 4, a shroud 10 is mounted around the frame support 22. The shroud 10 wraps the rotating assembly 30, the flywheel 40, the eddy-current brake, and the circuits for protecting the mechanism and the user. The front and rear portions of the shroud 10, as shown in FIG. 4, are very close to the front edge and the rear edge of the circular path R, and the rear portion has two parallel slots 11.

The base 21 of the frame 20 includes two rails 24 extending forwardly from the rear end of the frame. The top of the rear section of each rail 24 forms a track 25. The two connecting points 34 respectively connect to the two supporting rods 60. Each supporting rod 60 has a front end connected pivotally to an outer side of the outer end of each of the crank arm 32, a middle portion passing through the slot 11 of the shroud 10, and a rear end provided with a respective roller 61 which moves back and forth on the corresponding longitudinal track 25. When the front ends of the supporting rods 60 move along the circular path R, the rear ends move correspondingly along the track 25 between a front point 26 and a rear point 27. Due to the angular difference of 180 degrees between the front ends of the supporting rods 60, the rear ends of the supporting rods will move in an opposite direction.

Figure 5:
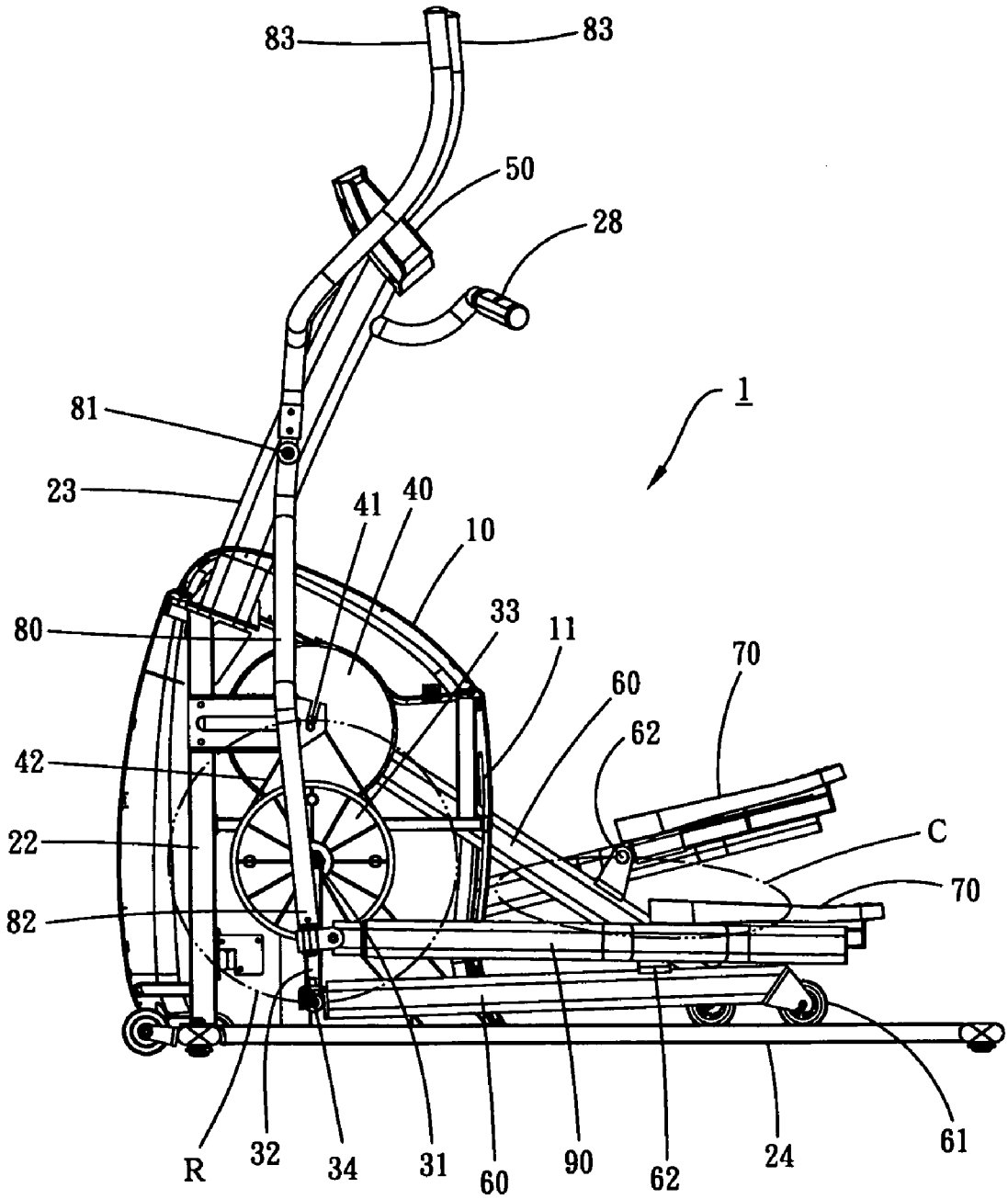
FIG. 5 is a left side view of the preferred embodiment of FIG. 4, and the two pedals respectively are at a higher end and a lower end in the movement area.
Figure 6:
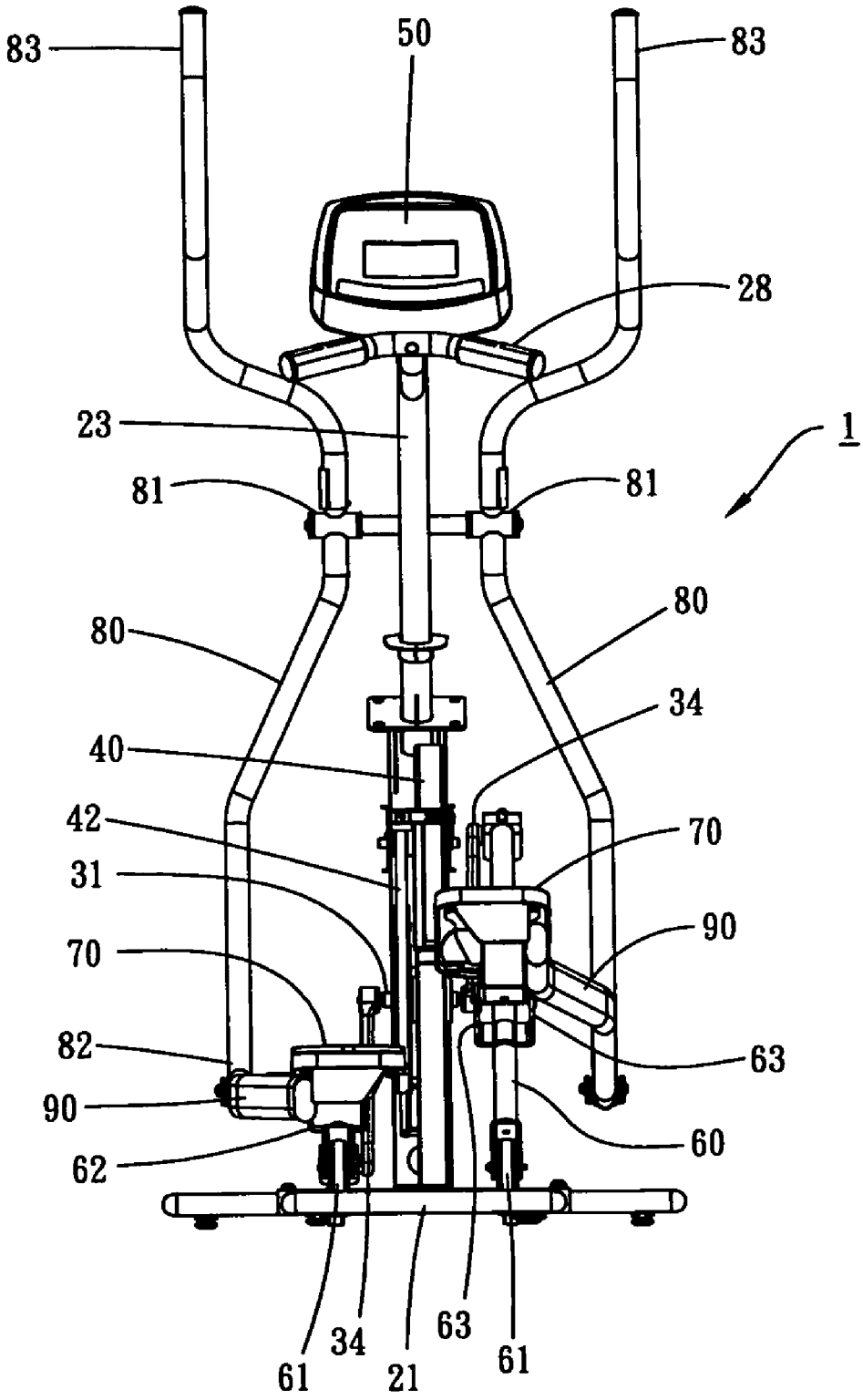
FIG. 6 is a front view of the preferred embodiment of FIG. 5.

The distance between the front and rear ends of the supporting rods 60 is greater than the diameter of the circular path R and smaller than two times the diameter of the circular path R. Each supporting rod 60 includes a supporting member 62 locating between the rear end and the middle of the supporting rod 60. Each supporting member 62 has two opposite fixed plates 63 (as shown in FIG. 6). Referring to FIGS. 4 and 5, the front ends are restricted to the circular motion and rear ends are restricted to the back and forth motion, so the supporting member 62 moves along a substantial elliptical closed path C. The long axis of the elliptical closed path C substantially corresponds to the longitudinal axis of the elliptical exercise apparatus, and the short axis of the elliptical closed path C substantially corresponds to the vertical axis of the elliptical exercise apparatus. The front end of the closed path C is very close to the rear end of the circular path R. Specifically, the horizontal distance between the closed path C and the circular path R is less than 20 cm, and the supporting member 62 is very close to the rear portion of the shroud 10 when it moves to the front end of the range of the motion.

Left and right pedals 70 for a user to stand on are respectively mounted on the supporting rods 60. Each pedal 70 has a front end corresponding to the user's toes and a rear end corresponding to the user's heel, and is mounted pivotally between the fixed plates 63 of the supporting member 62 of the supporting rod 60, so that the front end of each pedal 70 moves along the closed path C, and the pedal 70 moves relative to the supporting rod 60.

Left and right swing arms 80 are mounted respectively on the left and right sides of the frame 20 and extend substantially longitudinally. Each swing arm 80 includes a pivot point 81 formed at the middle section, a swing end 82 formed at the bottom end for swinging back and forth, and a handle 83 formed at the top end for a user to grip. The swing arms 80 are rotatably connected to the console mast 23 of the frame 20 through their respective pivot points 81.

The swing end 82 of each swing arm 80 is connected to a link 90. Each link 90 has a front end connected pivotally to the swing end 82 for restricting to move along an actuate path, and a rear end secured to a respective outer side of the pedal 70. So that the supporting rod 60 and the swing arms 80 are driven by each other via the link 90. When the link 90 moves, the angle between the link 90 and the supporting rod 60 will vary with the angle between the pedal 70 and the supporting rod 60.

During the use of the elliptical exercise apparatus 1, the user stands on the left and right pedals 70 and grips the left and right handles 83. The user imparts force to the pedals 70 and the handles 83, thereby causing the motions of the supporting rods 60, the rotating assembly 30, the links 90, and the swing arms 80, so that the pedals 70 travel along a substantial elliptical path. Left and right handles 83 move respectively along an actuate path in the opposite directions. In the same way, when one pedal 70 moves forward, the other pedal 70 moves rearward. And each handle 83 moves forward as its respective pedal 70 moves rearward, and vice versa. The user has an option to grip the handlebar 28 at the top of the console mast 23 to exercise his lower body only.

A user can adjust the resistance of the pedals 70 and the handles 83 by adjusting the resistance of the flywheel 40 via the console 50 described above.

During the operation period, while the pedal 70 moves along a downward and backward segment, as the left pedal 70 shown in FIG. 5 or the right pedal 70 shown in FIG. 4, the upper surface of the pedal is substantially horizontal. When the pedal 70 moves along the other segments of the motion path, the front end of the top of the pedal 70 will lower than the rear end of the top of the pedal 70, and it is apparent when the pedal 70 is at the top of the motion path. The angular variation of the pedal conforms with the angular variation of the sole of a person's foot. Therefore a user feels comfortable and his legs may not ache or hurt easily while using the elliptical exercise apparatus 1 according to this invention.

As most clearly shown in FIGS. 4-5, the rear end of each supporting rod 60 is always under the corresponding pedal. As described above, the rear end of each supporting rod 60 moves back and forth between a front point 26 and a rear point 27 (as shown in FIG. 2). So that the front point 26 is not closer to the front region of the frame 20 than the front edge of the motion path of the front end of pedal 70, i.e. the closed path C, and the rear point 27 is not closer to the rear region of the frame than the rear edge of the motion path (not shown) of the rear end of the pedal 70. In other words, in the longitudinal direction, the front point 26 of the track 25 aligns transversely or is in back of the front edge of the closed path C of the front ends of the pedals 70, and the rear point 27 of the track 25 aligns transversely or is in front of the rear edge of the closed path C of the rear ends of the pedals 70.

As shown in FIG. 4, the position of the pivot point 81 is substantially over the center of the circular path R, and the longitudinal positions of the front end of the actuate path of swing end 82 and the front edge of the circular path R are substantially the same. More specifically, the preferred distance between the front end of the actuate path and the front edge of the circular path R is less than 10 cm. Therefore, during the use of the elliptical exercise apparatus, neither the bottom ends of the swing arm 80 nor the handles 83 of the swing arms 80 will be in front of the shroud 10.

As the figures and described above, the longitudinal length of the elliptical exercise apparatus 1 is substantial equal to the longitudinal length of the motion range of the crank arm 32 plus the longitudinal length of the motion range of the pedal 70. Compared with conventional elliptical exercise apparatuses, the elliptical exercise apparatus 1 of this invention not only provides an adequate travel of the pedals with ergonomic benefits, but also reduces the occupied space. So to a home user who has a limited indoor space, it is easy to place the exercise apparatus at the corner or to move it. To distributors or fitness centers, more exercise apparatuses can be displayed in the same area. To the manufacturers, size reducing can increase the stock density and reduce the production cost.

Figure 7:
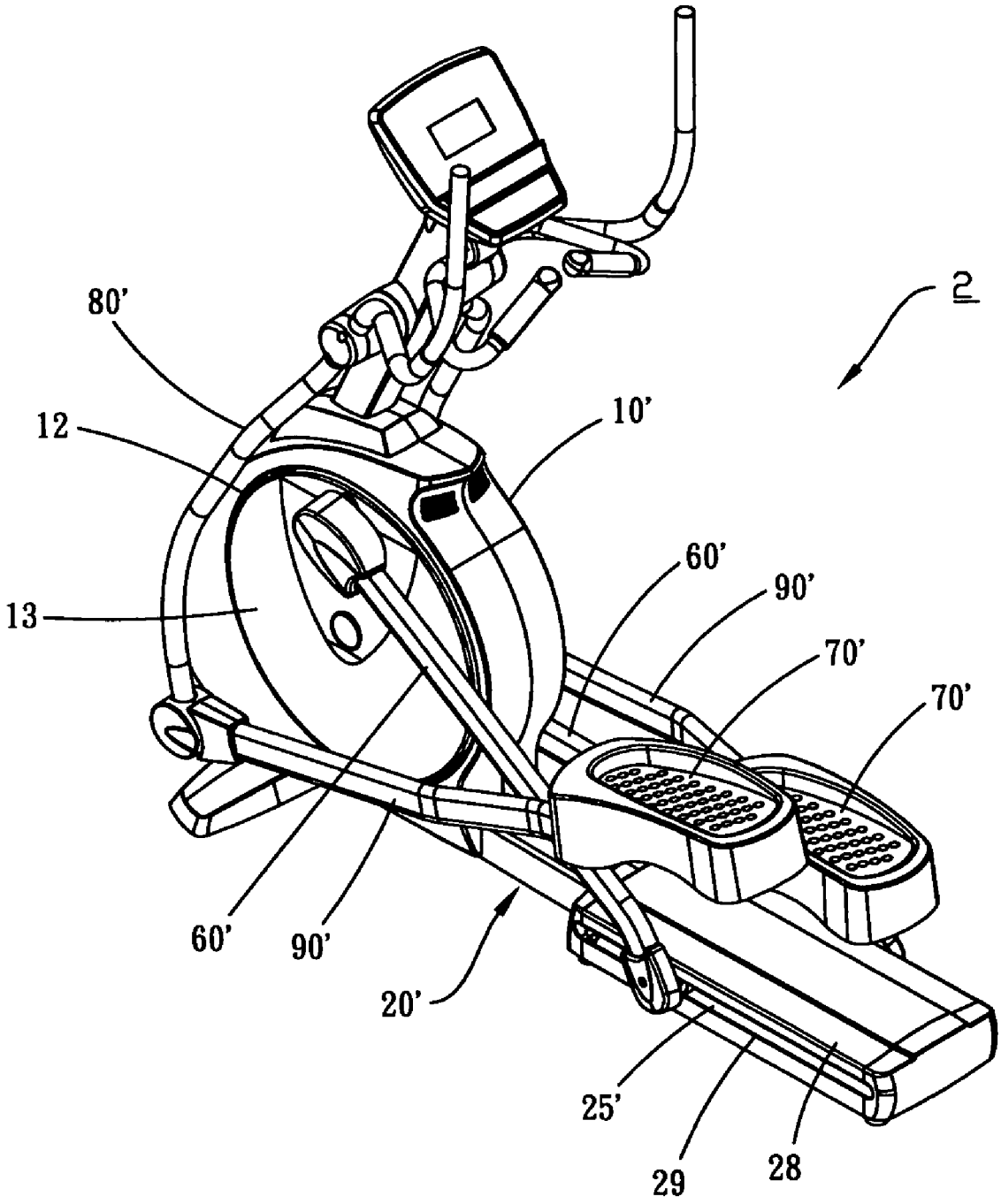
FIG. 7 is a perspective view of another preferred embodiment.
Figure 8:
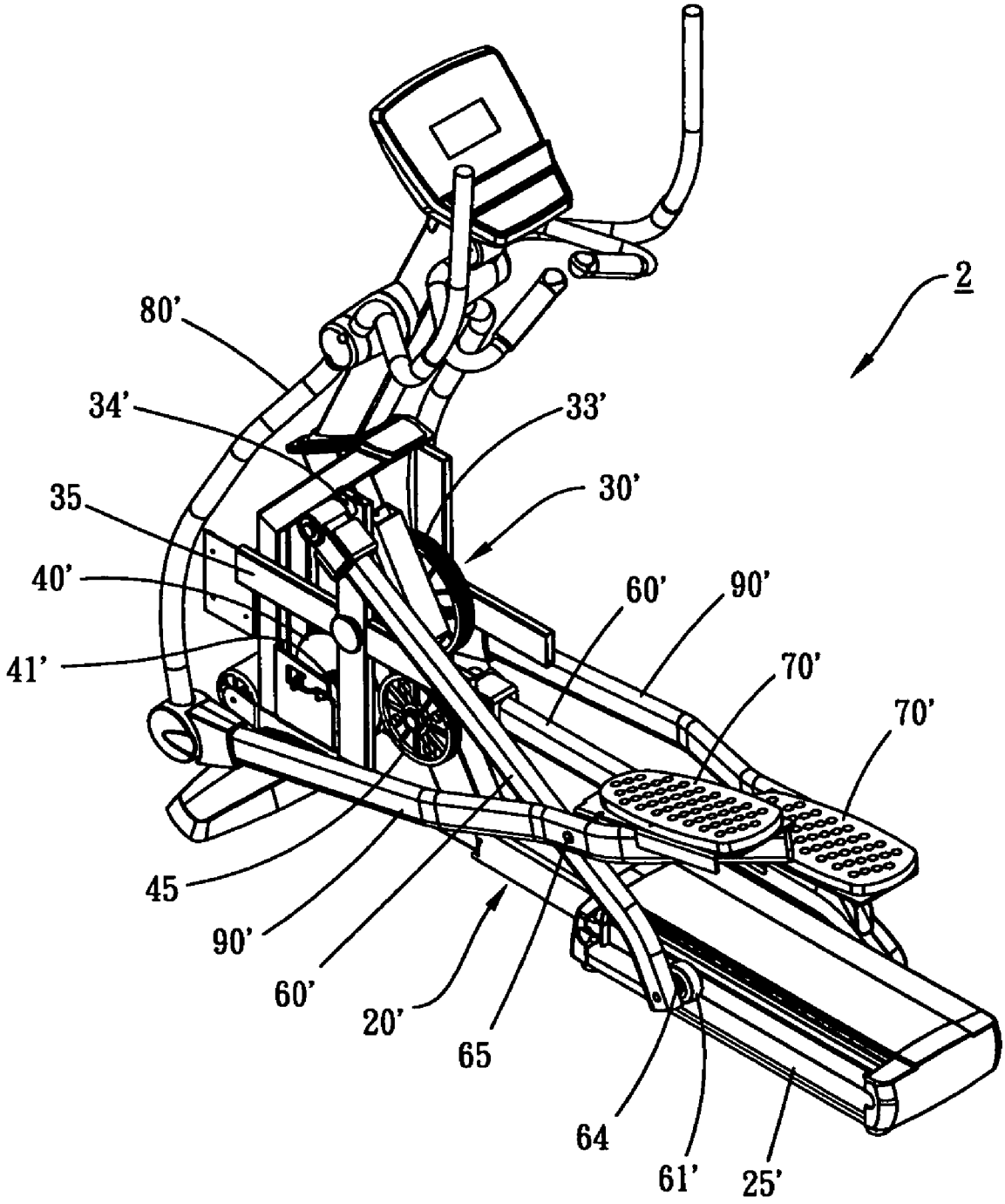
FIG. 8 is a perspective view of the preferred embodiment of FIG. 7 without some parts.
Figure 9:
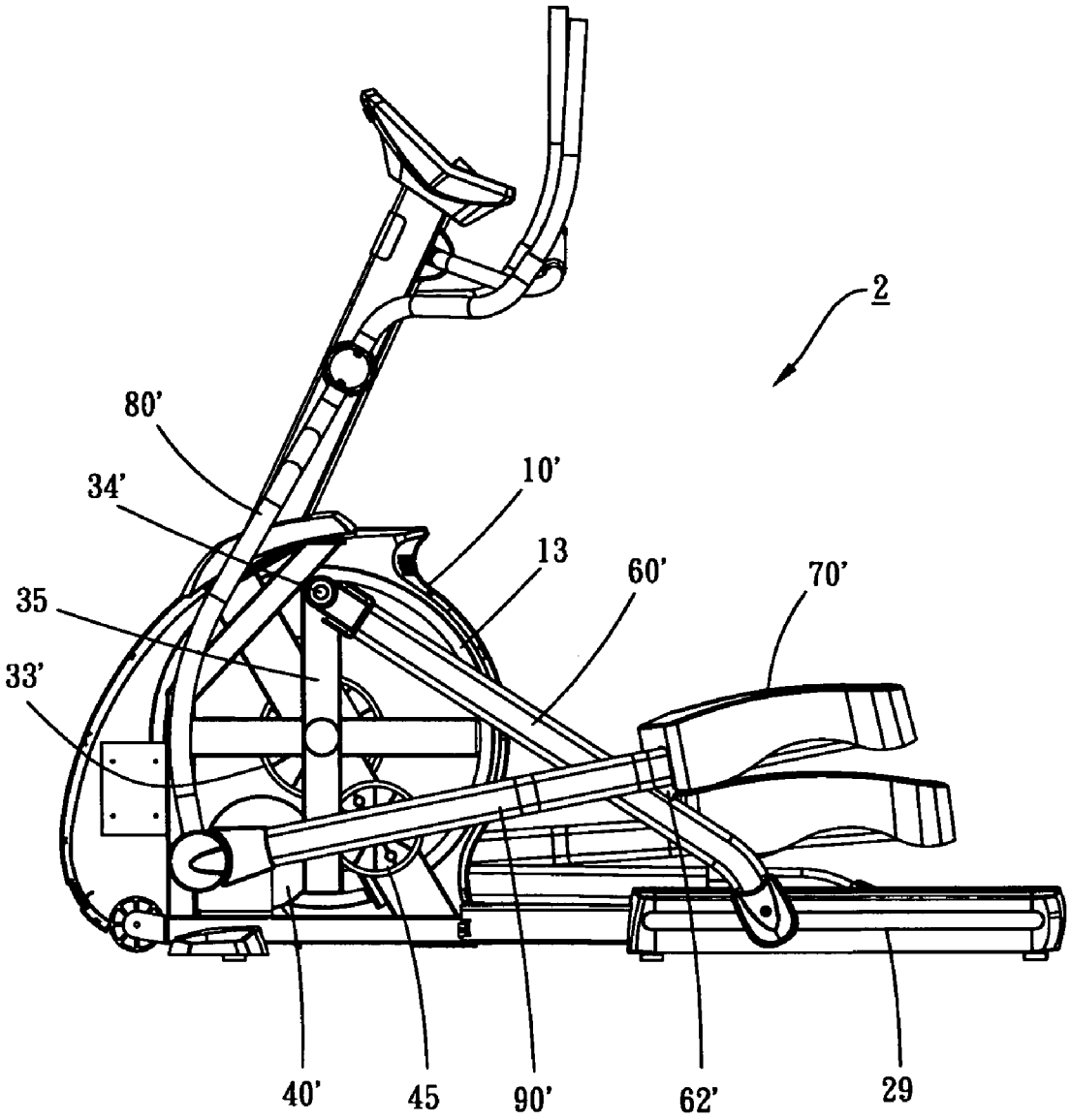
FIG. 9 is a left side view of the preferred embodiment of FIG. 7 without a left half shroud.

Another preferred embodiment according to the present invention is illustrated in FIGS. 7-9. This embodiment also includes the advantages described above, and the members and the relationships there between of this embodiment are substantial the same with those of the previous preferred embodiment. The different features will be described below.

As shown in FIGS. 7-9, a rotating assembly 30' includes two opposite cranks 35 which are in the shape of a cross. An outer end of a branch of each crank forms a connecting point 34'. A shroud 10' wraps the rotating assembly 30' in the front region of the frame 20' and has two round openings 12 corresponding to the left side and a right side of the cranks 35. Two round plates 13 are attached respectively to the cranks 35 beside the round openings 12. Respectively, the front ends of the supporting rods 60' are connected pivotally to the connecting point 34' outside the round plates 13. In this embodiment, the width of the shroud 10' is narrower than that in the embodiment described above.

Left and right tracks 25' which extend longitudinally are mounted on the rear end of the base of the frame 20'. The tracks 25' are under a cover 28' and on two opposite sides of the cover 28'. The rear ends of the supporting rods 60' move outside the cover 28'. Two roller pivots 64 each passes through a slot 29 on the side of the cover 28' and has two opposite ends. One end is connected to the rear end of supporting rod 60', and the other end is connected to a corresponding roller 61' within the cover 28'. So the rollers 61' can travel on the tracks 25' and are protected by the cover 28'.

In the embodiment, the flywheel 40' is smaller than that in the previous embodiment, and the position of the flywheel 40' is lower than the rotating assembly 30', so that the shroud 10' is close to the rotating assembly 30'. A medium pulley set 45 is coupled pivotally within the shroud 10' and composed of a large wheel and a small wheel. The large pulley 33' of the rotating assembly 30' connects with the small wheel of the medium pulley set 45 via a belt, and the large wheel of the medium pulley set 45 connects with the small pulley 41' of the flywheel 40' via another belt (not shown), so that the transmission can be completed in a limited space.

In the previous preferred embodiment, the pedals 70 are mounted pivotally respectively on the supporting rods 60 and connected to the links 90, and the links 90 are not connected to the supporting rods 60 directly. In the present embodiment, the front ends of the pedals 70' are also mounted pivotally respectively on the supporting member 62' of the supporting rods 60'. The main difference between the two embodiments is the links 90 are connected respectively to the supporting members 62' through the axis 65. The rear ends of the links 90 respectively curve inward to the bottom of the pedals 70' for fixing thereon, so that the pedals 70' are mounted more stably on the supporting rods 60'.

The other parts in this embodiment, such as the relationships or the distances between the members, and scale of the members are all the same with those in the previous embodiment. The elliptical exercise apparatus 2 provides the complete travel of the pedals with ergonomic benefits and save space, too. Compared with the previous embodiment, the shroud 10' in this embodiment is lower and narrower.

The present invention does not require that all the advantageous features and all the advantages need to be incorporated into every embodiment thereof Although the present invention has been described in considerable detail with reference to certain preferred embodiment thereof, other embodiments are possible. For example, in an alternate embodiment, a preselected portion between the front and rear ends of each link is connected pivotally to the supporting member of the supporting rod directly, and each pedal is fixed secured to the rear end of the link without connecting to the supporting rod. In another alternate embodiment, the front end of a pedal and the rear end of a corresponding link mounted pivotally coaxially on the supporting member of the supporting rod, and the pedal and the link are connected at the pivot point, i.e. at least one of the pedal and the link is connected pivotally to the supporting rod, so that the pedal and the link can rotate about the supporting rod.

What is claimed is:

1. An exercise apparatus comprising:

a frame adapted to rest on a surface, the frame including a front end, a rear end, a front region, and a rear region, the rear region having two tracks extending longitudinally;

a rotating assembly mounted on the front region of the frame, the rotating assembly having two opposite connecting points moving along a circular path, and the distance between the bottom of the circular path and the tracks is smaller than 10 cm;

a flywheel mounted pivotally on the front region of the frame and connected to the rotating assembly, the flywheel being rotatable simultaneously with the connecting points;

left and right supporting rods respectively having a front end, a rear end, and a supporting member therebetween, the respective distance between the front ends and the corresponding rear ends of the supporting rods being greater than the diameter of the circular path and smaller than two times diameter of the circular path, the supporting member located between the rear end and the middle of the supporting rod, the front ends of the supporting rods connected pivotally to the connecting points respectively, the rear ends of the supporting rods moving along the track between a front point and a rear point so as to cause the supporting member to move along an arcuate closed path, therefore in the longitudinal direction, the front edge of the closed path aligns transversely or is in back of the rear edge of the circular path, and the longitudinal horizontal distance between the front edge of the closed path and the rear edge of the circular path is smaller than 20 cm;

left and right swing arms each having a pivot point connected to the front region of the frame, and a swing end located below the pivot point for moving back and forth;

left and right links each having a front end and a rear end, the front ends respectively pivotally connected to the swing ends of the swing arms; and left and right pedals connected respectively to the rear ends of the links and located behind the corresponding supporting members of the supporting rods, the left and right pedals further connected pivotally to the supporting members;

wherein, in the longitudinal direction, the front point of the track aligns transversely or is in back of the front edge of the motion path of the front ends of the pedals, and the rear point of the track aligns transversely or is in front of the rear edge of the motion path of the rear ends of the pedals.

2. The exercise apparatus of claim 1, wherein in the longitudinal direction, the rear edge of the flywheel aligns transversely or is in front of the rear edge of the circular path.

3. The exercise apparatus of claim 2, wherein in the longitudinal direction, the front edge of the flywheel aligns transversely or is in back of the front edge of the circular path.

4. The exercise apparatus of claim 2, wherein in the vertical direction, the top of the flywheel aligns horizontally or is below the top of the circular path.

5. The exercise apparatus claim 2, wherein the exercise apparatus further comprises a shroud for covering the rotating assembly and the flywheel, and the rear portion of the shroud is located between the circular path and the closed path.

6. The exercise apparatus of claim 1, wherein each of the pivot points of the swing arms are located substantially over the axis of the circular path, and the distance between the front end of the motion path of the swing arm and the front edge of the circular path is less than 10 cm.

7. The exercise apparatus of claim 1, wherein each pedal is located over the corresponding supporting rod, and the front end of the pedal is mounted pivotally directly on the supporting member of the supporting rod.

8. The exercise apparatus of claim 7, wherein the rear end of each the link extends and connects to the bottom of the corresponding pedal.

9. The exercise apparatus of claim 8, wherein a corresponding portion of the link and the front end of the pedal connect pivotally coaxially to the supporting member of the supporting rod.

* * * * *